US007510409B2

(12) United States Patent
Yu

(10) Patent No.: US 7,510,409 B2
(45) Date of Patent: Mar. 31, 2009

(54) ELECTRONIC DEVICE HAVING FOLDABLE PLUG

(75) Inventor: Wen-Lung Yu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/049,516

(22) Filed: Mar. 17, 2008

(65) Prior Publication Data

US 2009/0061666 A1 Mar. 5, 2009

(30) Foreign Application Priority Data

Aug. 28, 2007 (TW) ..... 96131915 A

(51) Int. Cl.
*H01R 13/60* (2006.01)
*H01R 13/44* (2006.01)

(52) U.S. Cl. ..... 439/131

(58) Field of Classification Search ..... 439/131, 439/172–174, 518, 52, 104
See application file for complete search history.

(56) References Cited

U.S. PATENT DOCUMENTS 6,275,002 B1 * 8/2001 Chen ..... 320/111
6,312,271 B1 * 11/2001 Tseng ..... 439/131

* cited by examiner

*Primary Examiner*—Javaid Nasri
(74) *Attorney, Agent, or Firm*—Kirton & McConkie; Evan R. Witt

(57) ABSTRACT

An electronic device includes a casing, a plug, a fixing plate, a circuit board and a first retaining part. The casing has a support member and multiple perforations. The plug has a rotating shaft and multiple pins. The pins are mounted on the rotating shaft. The rotating shaft is pivotally supported on the support member such that the pins are rotatable with respect to the rotating shaft. The pins are substantially perpendicular to the casing when the pins are rotated to a first position. The pins are received in the perforations when the pins are rotated to a second position. The fixing plate is disposed on the support member. The circuit board includes multiple contact elements corresponding to the pins. The first retaining part is engaged with or sustained against an engaging part of the rotating shaft, thereby positioning the pins of the plug in the first position.

16 Claims, 11 Drawing Sheets

ELECTRONIC DEVICE HAVING FOLDABLE PLUG

FIELD OF THE INVENTION

The present invention relates to an electronic device having a plug, and more particularly to an electronic device having a foldable plug.

BACKGROUND OF THE INVENTION

Power converters such as power adapters or chargers become indispensable electronic devices for many kinds of electrical apparatuses. For example, by means of the power adapters, the utility power may be rectified and then converted into DC power for supplying power-receiving devices such as notebook computers. Alternatively, by means of the chargers, the converted DC power may be charged into the rechargeable batteries of the power-receiving devices such as mobile phones or digital cameras.

A power converter principally includes a casing, a plug and a circuit board mounted within the casing. Via the plug, external power is transmitted to the circuit board. The arrangement of the circuit board is dependent on the function of the power converter, for example being as an adapter or a charger, to perform rectification or conversion for a power-receiving device.

Referring to FIG. 1, a schematic perspective view of a conventional power adapter is illustrated. The power adapter 10 of FIG. 1 includes a casing 11, a plug 12 and a circuit board (not shown) mounted within the casing 11. Conventionally, the plug 12 of a power adapter is composed of two conducting pins, which are projected from one side of the casing 11. In a case that the power adapter is not in use, a user is easily hurt by the tips of projected pins or the projected pins are readily bent or broken due to a sudden impact. In addition, the plug 12 is difficultly stored when the power adapter is not used.

Recently, a power converter having a foldable plug has been developed in order to solve the above problems. Please refer to FIGS. 2A and 2B, which are respectively perspective and cross-sectional views illustrating a power converter having a foldable plug. The power converter 20 of FIGS. 2A and 2B includes a casing 21 and a plug 22. The casing 21 further has a concave portion 23 near the top edge of the casing 21. The plug 22 principally includes a rod 220, two first pins 221 and two second pins 222. Both ends of the rod 220 are formed as tenons 2201. The first pins 221 and the second pins 222 respectively have holes 223 and 224 corresponding to the tenons 2201. The tenons 2201 are inserted into the holes 223 and 224 such that the first pins 221 and the second pins 222 are fixed onto the rod 220. Each sidewall of the concave portion 23 has a spring receptacle 226 containing a spring 227 therein. An end of the spring 227 is in contact with a side of the spring receptacle 226 and the other end of the spring 227 is coupled with a sustaining element 228. The sustaining element 228 is embedded into an indentation 225 of the first pin 221. As a consequence, the plug 22 is positioned in the concave portion 23 by the resilience force of the springs 227. By rotating the first pins 221 with respect to the rod 220, the second pins 222 are rotated to be contacted with contact points of the circuit board. Meanwhile, the plug 22 may be inserted into a power socket (not shown) to receive external power.

Although the above-mentioned power converter has a foldable plug, there are still some drawbacks. For example, the configuration of the foldable plug and the process for assembling such a foldable plug are complicated. In addition, the plug is usually not securely positioned on the casing because the pins are easily detached from the tenons.

In views of the above-described disadvantages resulted from the conventional method, the applicant keeps on carving unflaggingly to develop an electronic device having a foldable plug according to the present invention through wholehearted experience and research.

SUMMARY OF THE INVENTION

It is an object of the present invention to provide an electronic device having a foldable plug, in which the foldable plug is easily assembled so as to reduce the manufacturing cost and time.

Another object of the present invention provides an electronic device having a foldable plug, which is securely fixed in either a folded position or an upright position.

In accordance with an aspect of the present invention, there is provided an electronic device having a foldable plug. The electronic device includes a casing, a plug, a fixing plate, a circuit board and a first retaining part. The casing has a support member and multiple perforations. The plug has a rotating shaft and multiple pins. The pins are mounted on the rotating shaft. The rotating shaft is pivotally supported on the support member such that the pins are rotatable with respect to the rotating shaft to at least a first position and a second position. The pins are penetrated through the perforation and substantially perpendicular to the casing when the pins are rotated to the first position, and the pins are received in the perforations when the pins are rotated to the second position. The fixing plate is disposed on the support member such that the plug is pivotally supported between the support member and the fixing plate. The circuit board is disposed within the casing and includes multiple contact elements corresponding to the pins. The first retaining part is disposed on the fixing plate and engaged with or sustained against an engaging part of the rotating shaft, thereby positioning the pins of the plug in the first position.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
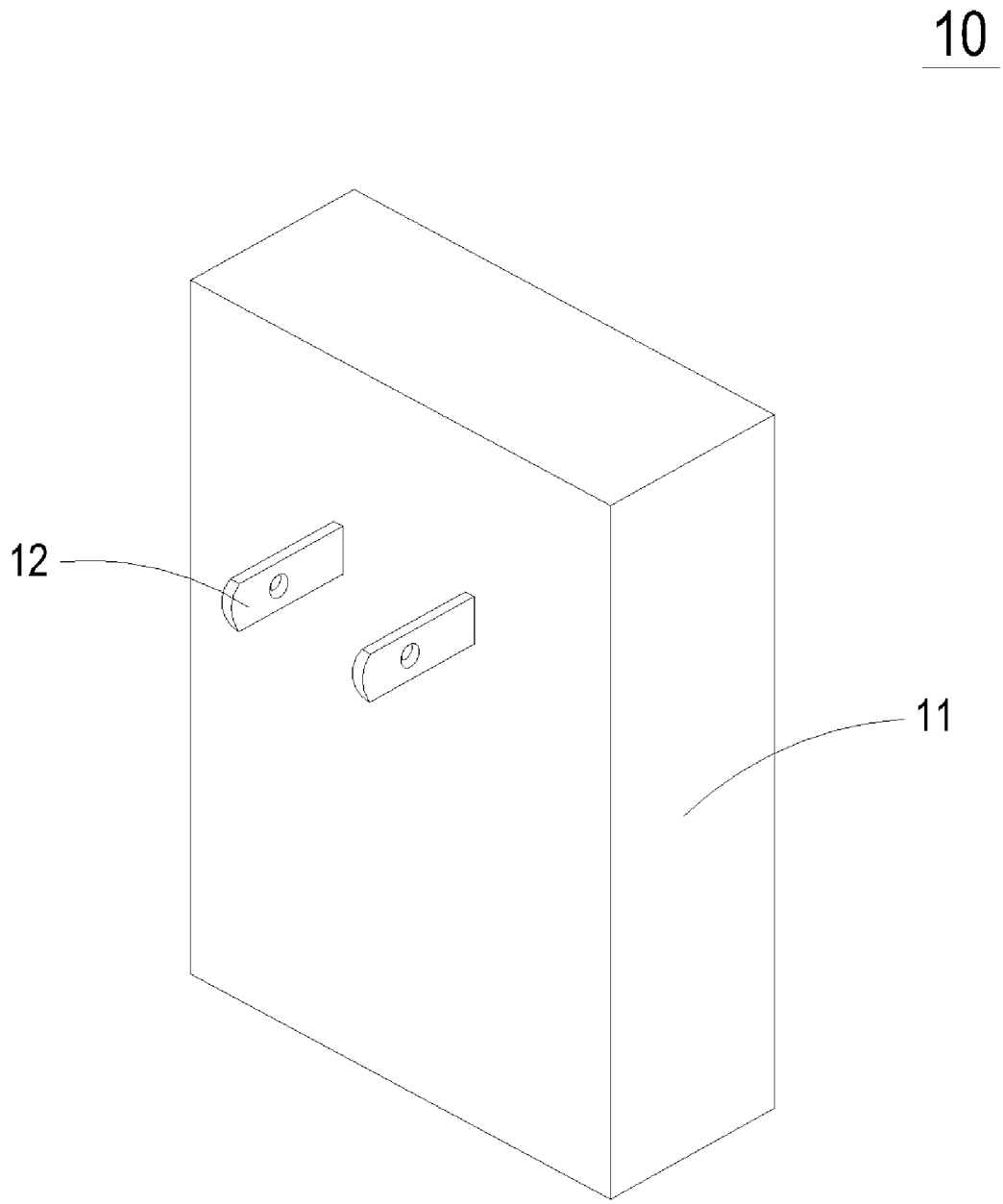
FIG. 1 PRIOR ART
FIG. 1 is a schematic perspective view of a conventional power adapter.
Figure 2A:
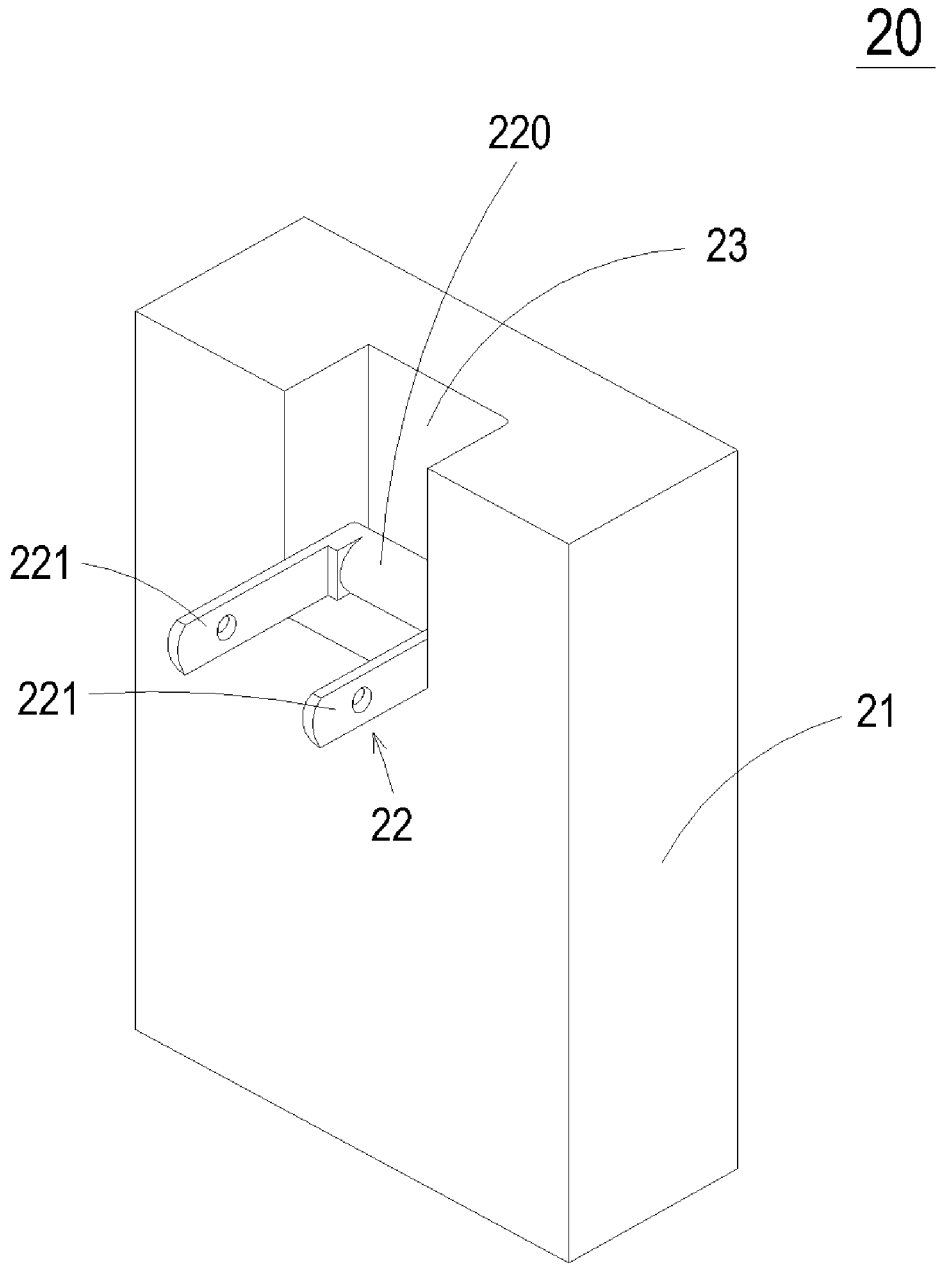
FIG. 2A PRIOR ART
FIGS. 2A and 2B are respectively perspective and cross-sectional views of a power converter having a foldable plug.
Figure 2B:
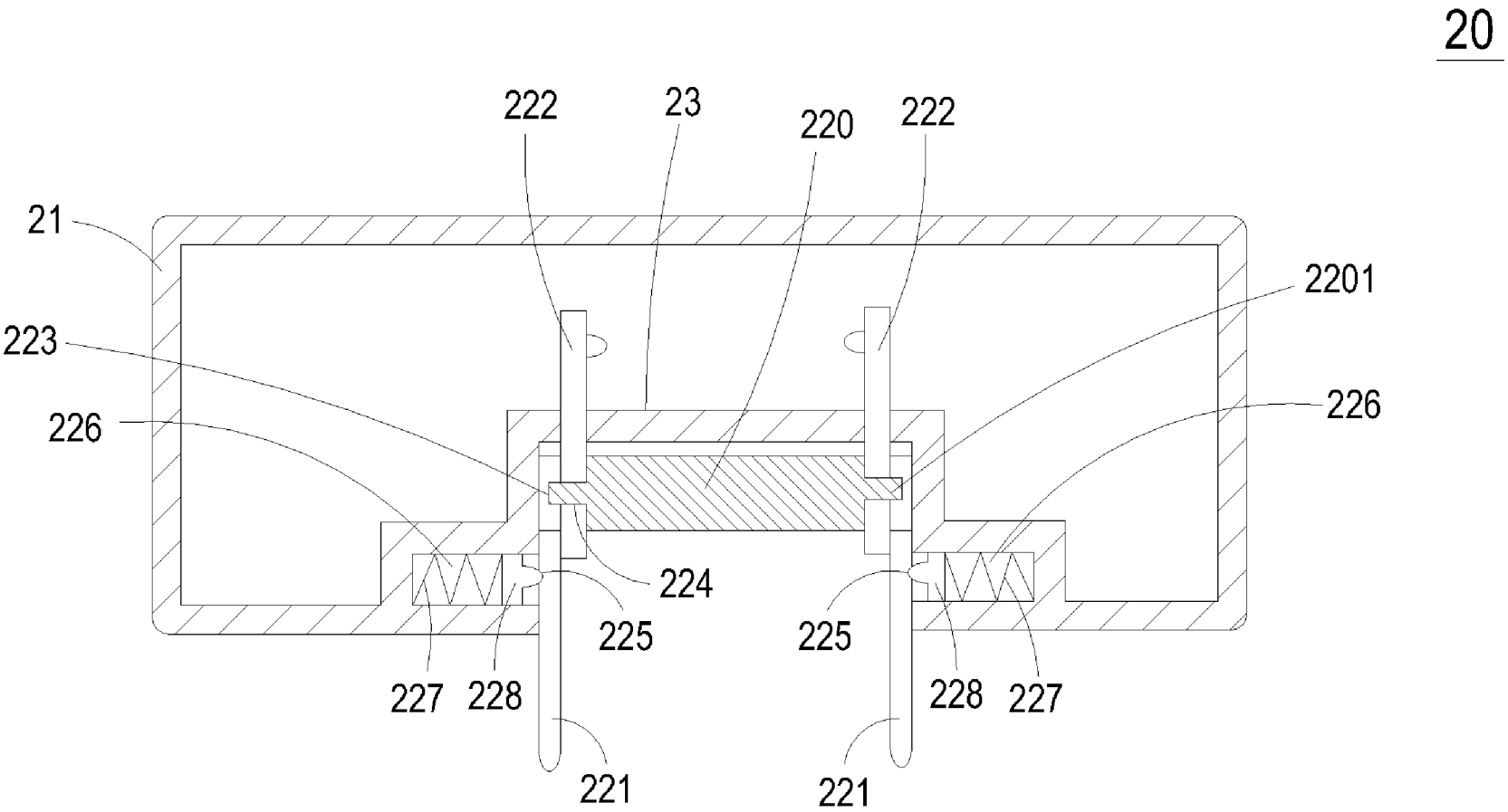
FIG. 2B PRIOR ART
Figure 3:
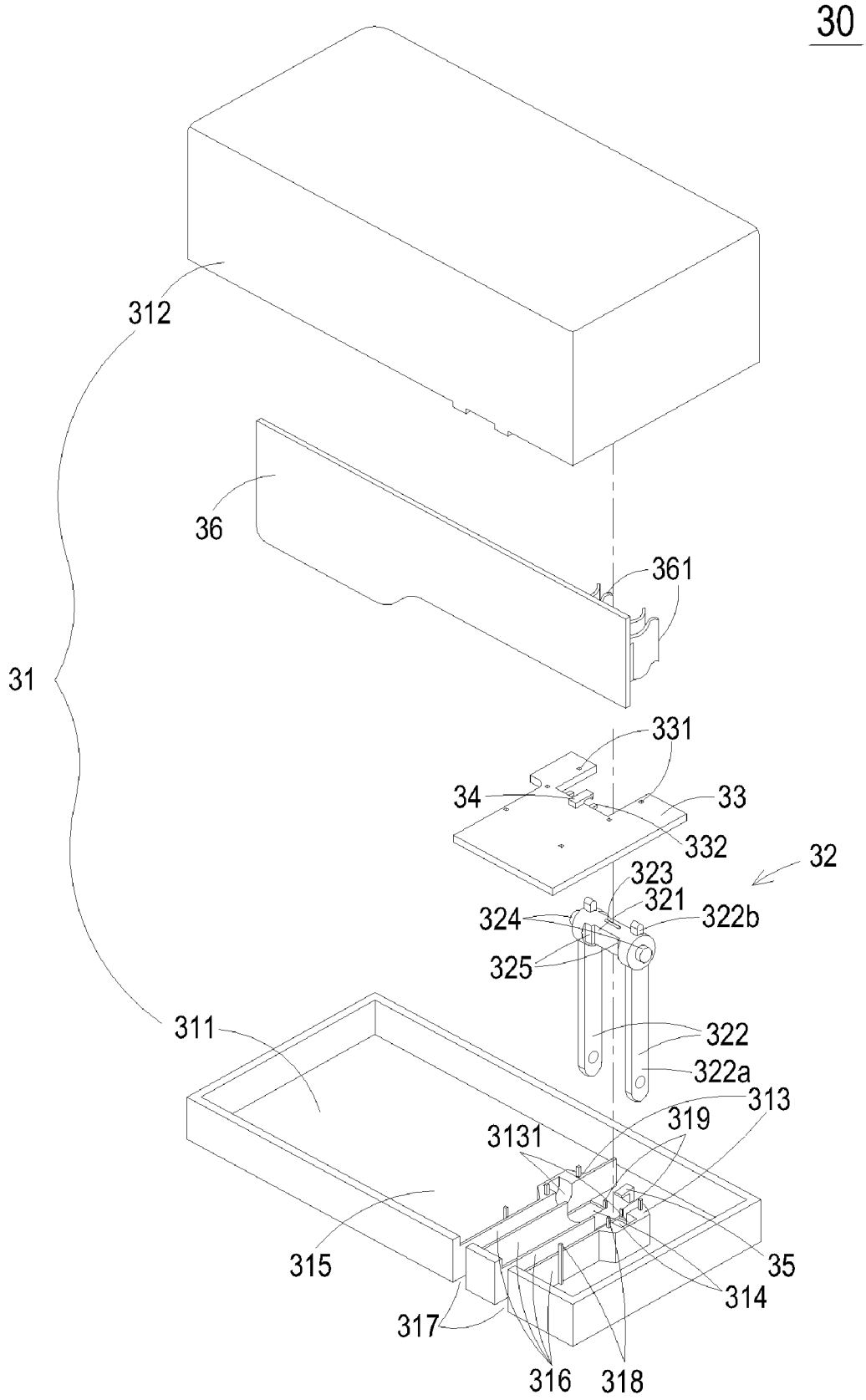
FIG. 3 is a schematic exploded view illustrating an electronic device having a foldable plug according to a first preferred embodiment of the present invention.

Please refer to FIG. 3, which is a schematic exploded view illustrating an electronic device having a foldable plug according to a first preferred embodiment of the present invention. An example of the electronic device 30 includes but is not limited to a power converter. The electronic device 30 principally includes a casing 31, a plug 32, a fixing plate 33, a first retaining part 34 and a circuit board 36. The casing 31 includes a first cover 311, a second cover 312, a support member 313 and a plurality of perforations 314. The support member 313 is disposed on an inner surface 315 of the first cover 311. The perforations 314 are penetrated through the first cover 311 and extended from the support member 313 to an edge of the first cover 311. In addition, several partition plates 316 are protruded from the inner surface 315 of the first cover 311. The partition plates 316 are connected to the support member 313 and extended along the peripheries of the perforations 314.

The plug 32 includes a rotating shaft 321 and multiple (e.g. two) pins 322. The pins 322 are substantially perpendicular to the rotating shaft 321. Each pin 322 is partially embedded into the rotating shaft 321 such that a first end 322*a* and a second end 322*b* are arranged on opposite sides of the rotating shaft 321. The rotating shaft 321 of the plug 32 is pivotally supported on the support member 313 of the casing 31 such that the pins 322 may be rotated to several positions with respect to the rotating shaft 321. For example, the pins 322 may be rotated to a first position where the first ends 322*a* thereof is protruded through the perforations 314 and substantially perpendicular to the outer surface of the first cover 311. Alternatively, the pins 322 may be rotated to a second position where the pins 322 are folded to be substantially parallel with the outer surface of the first cover 311. For clarification, the first position and the second position are referred as an upright position and a folded position, respectively.

The fixing plate 33 is disposed on the support member 313 and the partition plates 316 such that both ends of the rotating shaft 321 are rotatable between the support member 313 and the fixing plate 33. The first retaining part 34 is arranged on the fixing plate 33. In some embodiments, the first retaining part 34 is connected to the fixing plate 33 or integrally formed on the fixing plate 33. Corresponding to the first retaining part 34, the rotating shaft 321 has an engaging part 323. In a case that the first retaining part 34 is a hook structure, the engaging part 323 is a recess structure or a protrusion structure to be engaged with or sustained against the hook structure. When the first retaining part 34 is engaged with the engaging part 323, the pins 322 of the plug 32 are positioned at the upright position. The circuit board 36 is disposed within the casing 31 and has a power conversion circuitry (not shown) thereon. In addition, the circuit board 36 has multiple contact elements 361 corresponding to the second ends 322*b* of the pins 322. It is noted that, however, those skilled in the art will readily observe that numerous modifications and alterations may be made while retaining the teachings of the invention. For example, the first retaining part 34 may be arranged on the inner surface of the first cover 311.

In some embodiments, the pins 322 are coupled with the rotating shaft 321 by a plastic molding process such that the first ends 322*a* and the second ends 322*b* are arranged on opposite sides of the rotating shaft 321. Both terminals of the rotating shaft 321 are formed as tenons 324. The support member 313 has notches 3131 corresponding to the tenons 324. After the tenons 324 of the rotating shaft 321 are supported on the notches 3131 of the support member 313 and the first ends 322*a* of the pins 322 are penetrated through the perforations 314, the fixing plate 33 is placed on the support member 313 to shelter the notches 3131. Moreover, multiple receiving parts 317 are defined by the fixing plate 33, the partition plates 316 and the perforations 314. When the pins 322 are rotated to the second position, the first ends 322*a* of the pins 322 are stored in the receiving parts 317.

In some embodiments, the fixing plate 33 has several openings 331. Corresponding to the openings 331, some posts 318 are protruded from the support member 313 and the inner surface 315 of the first cover 311. The fixing plate 33 is initially fixed on the support member 313 and the partition plates 316 by penetrating the posts 318 through the openings 331. Furthermore, the fixing plate 33 may be securely fixed on the support member 313 and the partition plates 316 by using an ultrasonic welding process, a thermal welding process or an adhesive bonding process.

In some embodiments, corresponding to the engaging part 323 of the rotating shaft 321, a second retaining part 35 is arranged on the inner surface 315 of the first cover 311. Preferably, the second retaining part 35 is integrally formed on the inner surface 315 of the first cover 311. In a case that the engaging part 323 of the rotating shaft 321 is a recess structure or a protrusion structure, the second retaining part 35 is a hook structure to be engaged with or sustained against the engaging part 323. When the second retaining part 35 is engaged with the engaging part 323, the pins 322 of the plug 32 are positioned at the folded position.

Optionally, the rotating shaft 321 of the plug 32 further includes at least one confining part 325. The confining part 325 is for example a flat raised surface between the pins 322. When the pins 322 of the plug 32 are rotated to the upright position, the confining part 325 is sustained against the peripheral of the partition plate 316 for facilitating confining the plug 32 in the upright position. In some embodiments, the fixing plate 33 may optionally include at least a stopping part 332 corresponding to the confining part 325. When the pins 322 of the plug 32 are rotated to the upright position, the stopping part 332 is sustained against the confining part 325 for facilitating confining the plug 32 in the upright position.

In some embodiments, one or more friction-enhancing elements 319 are arranged on the inner surface 315 of the first cover 311 and in the vicinity of the perforations 314. After the tenons 324 of the rotating shaft 321 are supported on the notches 3131 of the support member 313 and the rotating shaft 321 is pivotally supported on the support member 313, the friction-enhancing elements 319 are in contact with the rotating shaft 321. During rotation of the plug 32, the friction force generated between the rotating shaft 321 and the friction-enhancing elements 319 may prevent the plug 32 from being detached.

Please refer to FIG. 3 again. The circuit board 36 and the plug 32 are arranged on opposite sides of the fixing plate 33. The circuit board 36 has multiple contact elements 361 corresponding to the second ends 322*b* of the pins 322. When the plug 32 is rotated to the upright position, the contact elements 361 of the circuit board 36 are contacted with the second ends 322*b* of the pins 322. Whereas, when the plug 32 is rotated to the folded position, the contact elements 361 of the circuit board 36 are separated from the second ends 322*b* of the pins 322.

Figure 4A:
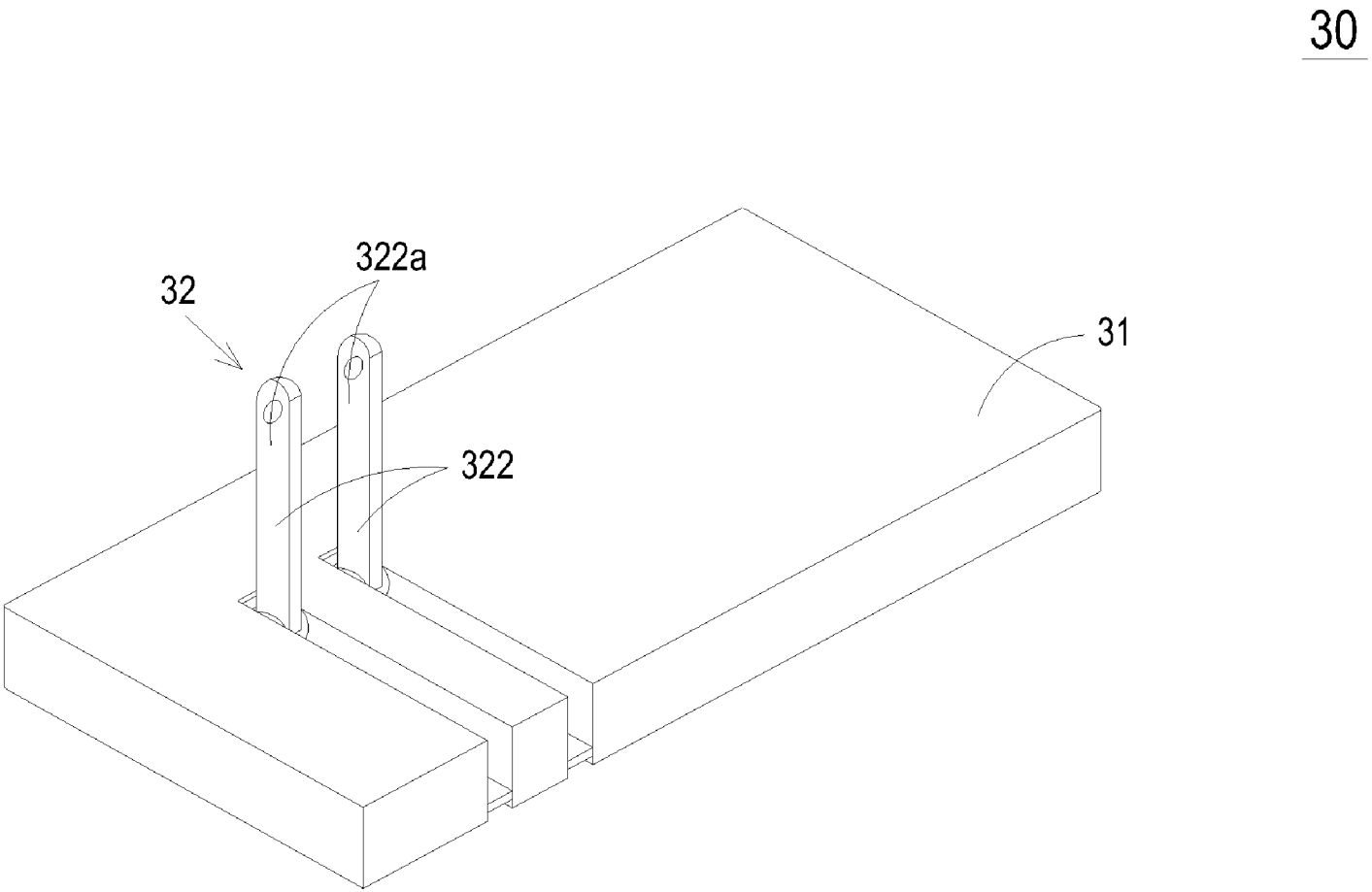
FIGS. 4A and 4B schematically illustrate front and rear views of the electronic device of FIG. 3, respectively, in which the plug is fixed in the upright position.
Figure 4B:
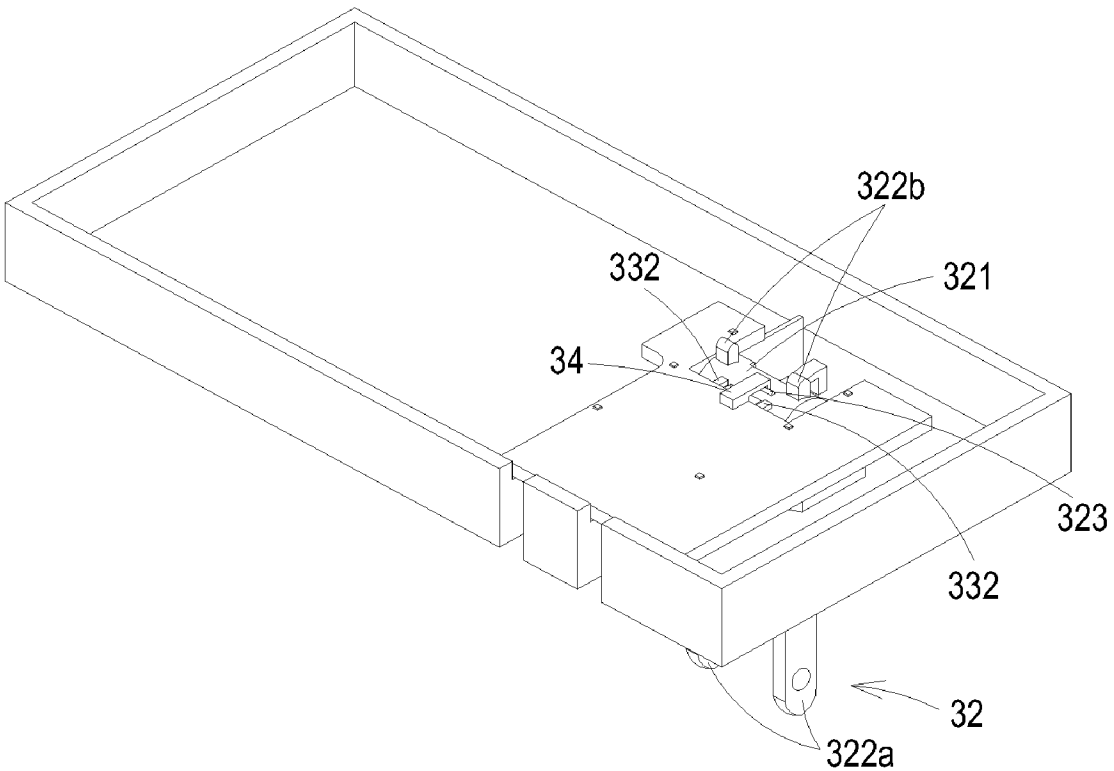

FIGS. 4A and 4B schematically illustrate front and rear views of the electronic device of FIG. 3, respectively, in which the plug is fixed in the upright position. For clarification, the circuit board 36 and the second cover 312 are not shown in the drawings. Please refer to FIG. 3, FIG. 4A and FIG. 4B. For a purpose of transmitting external power to the circuit board 36 of the electronic device 30, an external force may be applied on the first ends 322*a* of the pins 322 of the plug 32. In response to the external force, the plug 32 is rotated with respect to the rotating shaft 321 to the upright position. Meanwhile, the first retaining part 34 is engaged with or sustained against the engaging part 323 such that the plug 32 is positioned at the upright position. When the pins 322 of the plug 32 are rotated to the upright position, the stopping part 332 is sustained against the confining part 325 for facilitating confining the plug 32 in the upright position. Moreover, since the contact elements 361 of the circuit board 36 are contacted with the second ends 322*b* of the pins 322, the plug 32 may be inserted into a power socket to transmit external power to the circuit board 36.

Figure 5A:
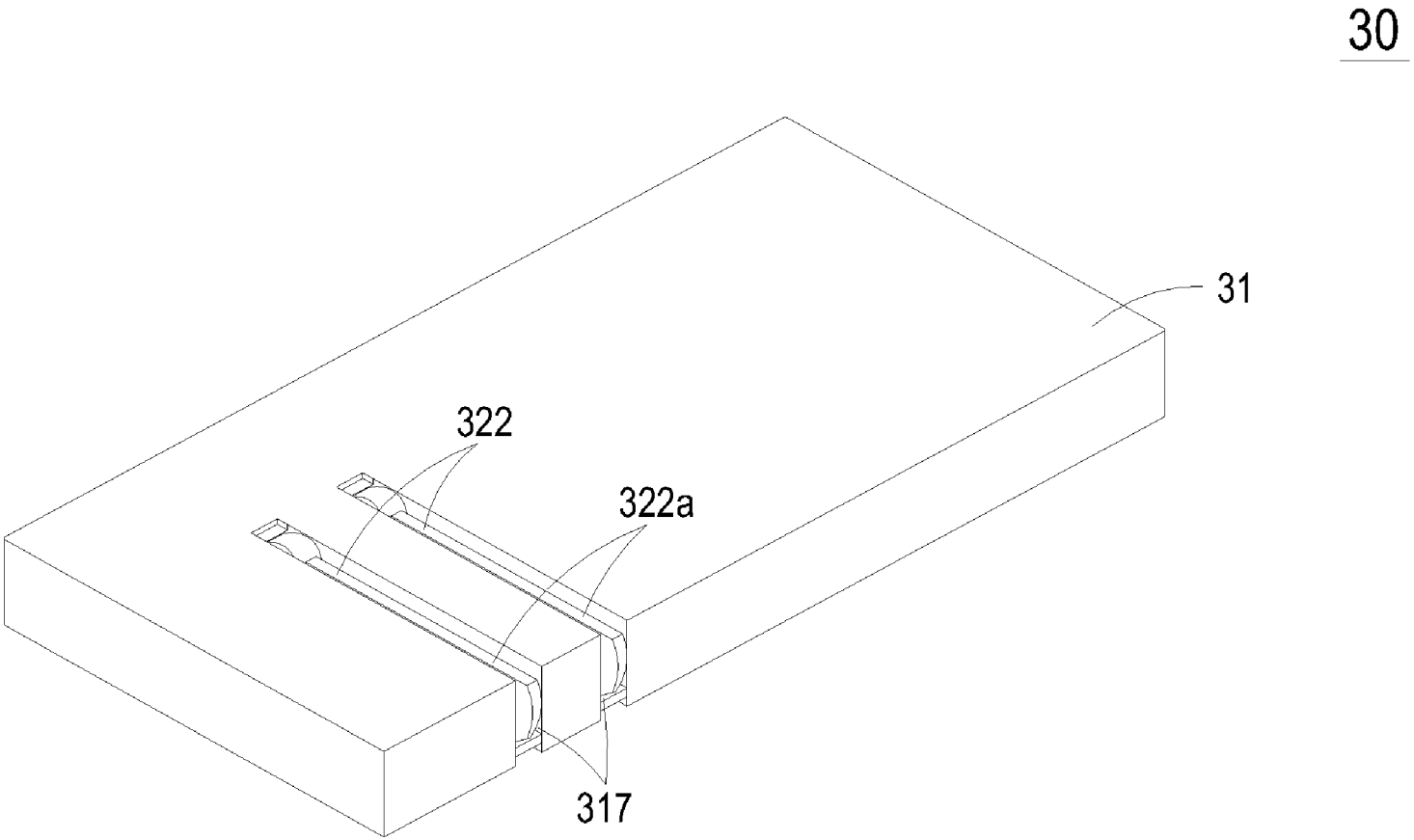
FIGS. 5A and 5B schematically illustrate front and rear views of the electronic device of FIG. 3, respectively, in which the plug is fixed in the folded position.
Figure 5B:
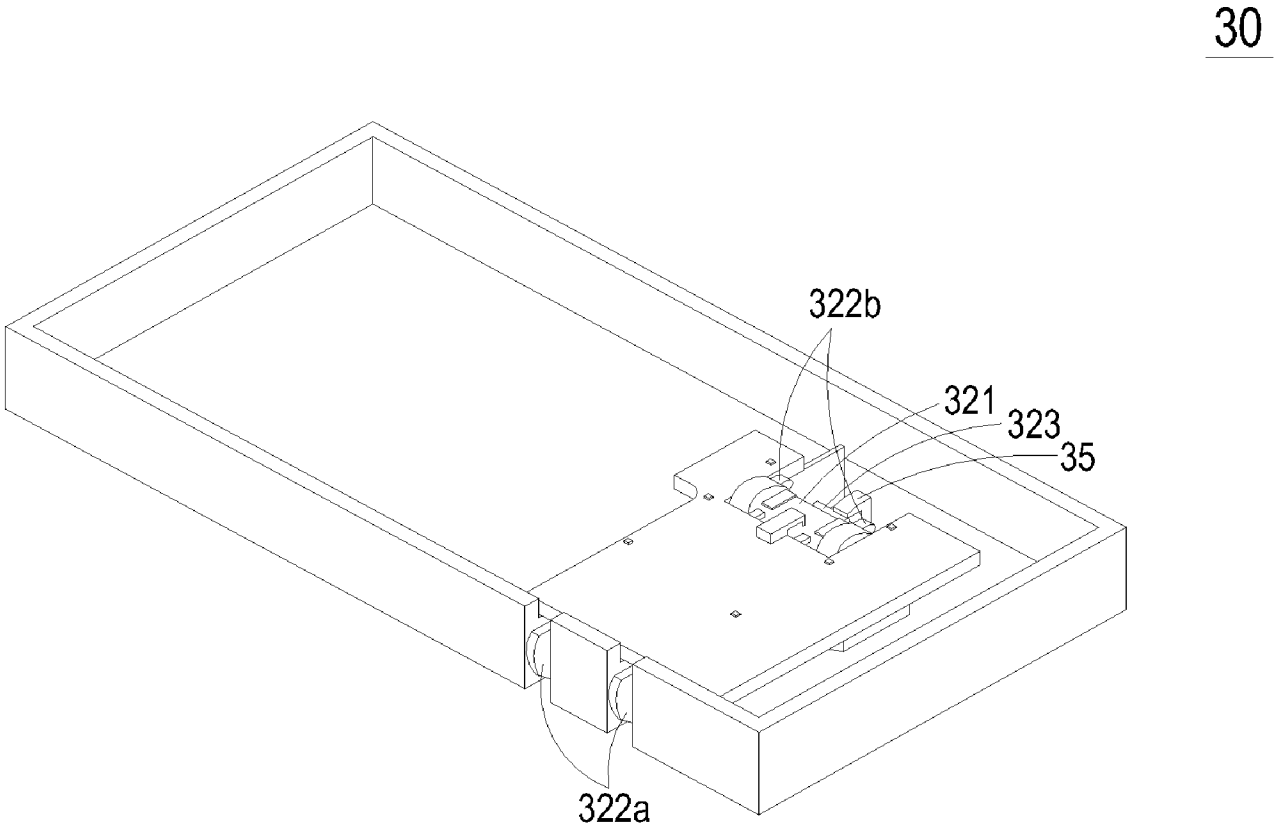

FIGS. 5A and 5B schematically illustrate front and rear views of the electronic device of FIG. 3, respectively, in which the plug is fixed in the folded position. For clarification, the circuit board 36 and the second cover 312 are not shown in the drawings. Please refer to FIG. 3, FIG. 5A and FIG. 5B. For a purpose of storing the plug 32, an addition external force may be applied on the first ends 322*a* of the pins 322 of the plug 32. In response to the external force, the plug 32 is rotated with respect to the rotating shaft 321 to the folded position and thus the first ends 322*a* of the pins 322 are stored in the receiving parts 317. Meanwhile, the second retaining part 35 is engaged with or sustained against the engaging part 323 such that the plug 32 is positioned at the folded position. Moreover, since the contact elements 361 of the circuit board 36 are separated from the second ends 322*b* of the pins 322, the electrical safety is enhanced.

Figure 6:
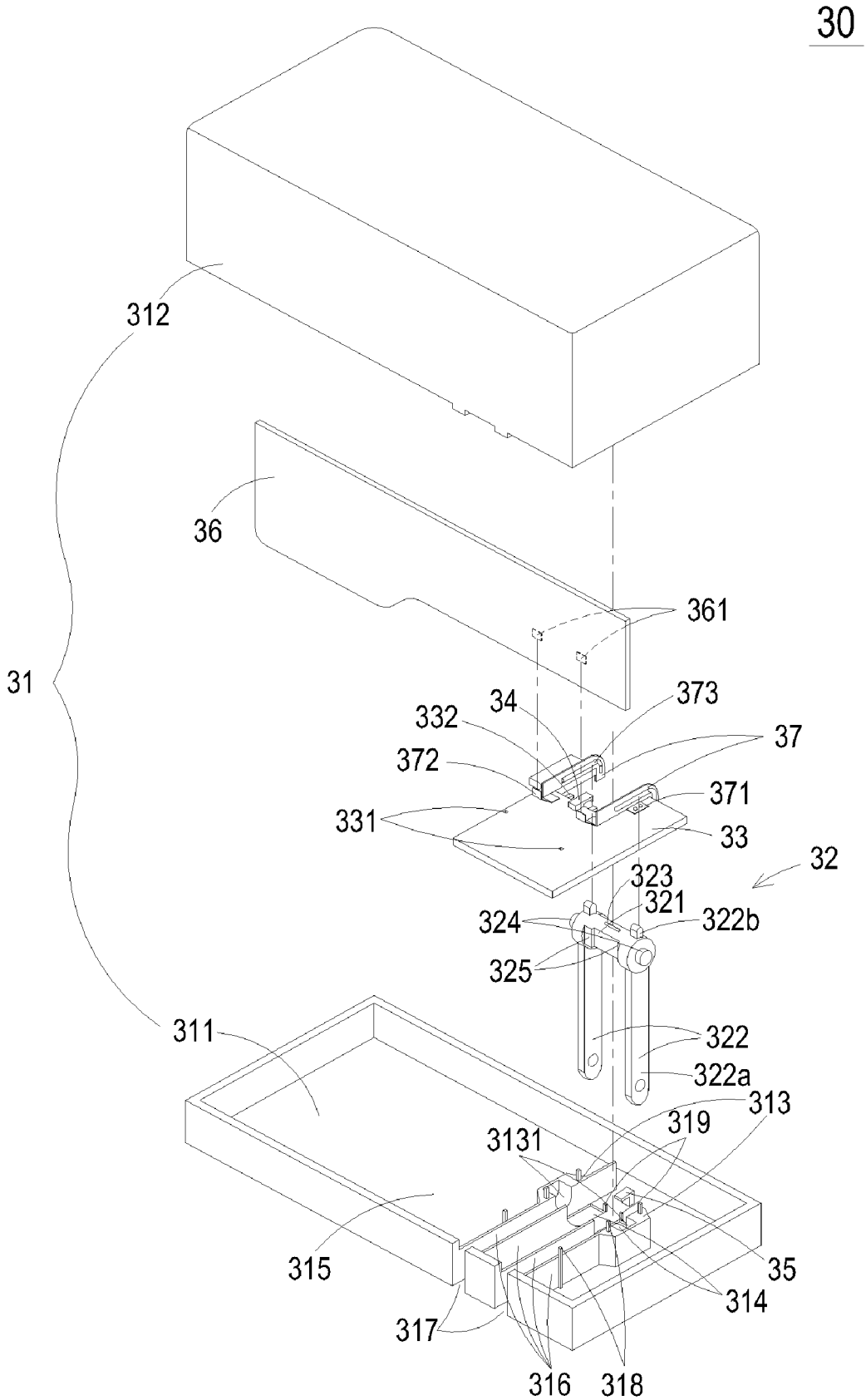
FIG. 6 is a schematic exploded view illustrating an electronic device having a foldable plug according to a second preferred embodiment of the present invention.

FIG. 6 is a schematic exploded view illustrating an electronic device having a foldable plug according to a second preferred embodiment of the present invention. In this embodiment, the casing 31, the plug 32, the fixing plate 33, the first retaining part 34 and the second retaining part 35 included therein are similar to those shown in FIG. 3, and are not redundantly described herein. In addition, the circuit board 36 is disposed within the casing 31 and has a power conversion circuitry (not shown) thereon. The circuit board 36 has multiple contact elements 361 for example two contact pads. Moreover, a plurality of conducting devices 37 for example two conducting devices are disposed on the fixing plate 33. Each of the conducting devices 37 has a fixing part 371, a first contact part 372 and a second contact part 373. The conducting device 37 is secured on the fixing plate 33 via the fixing part 371. The first contact part 372 of the conducting device 37 is employed to contact with a corresponding contact element 361 disposed on the circuit board 36, and the second contact part 373 is employed to always contact with the second end 322*b* of the pin 322. Therefore, when the plug 32 is rotated to the folded position, the contact elements 361 of the circuit board 36 are contacted with the first contact parts 372 of the conducting devices 37 and the second ends 322*b* of the pins 322 are contacted with the second contact parts 373 of the conducting devices 37. In addition, when the plug 32 is rotated to the upright position, the contact elements 361 of the circuit board 36 are contacted with the first contact parts 372 of the conducting devices 37 and the second ends 322*b* of the pins 322 are contacted with the second contact parts 373 of the conducting devices 37 so that the contact elements 361 of the circuit board 36 are electrically coupled with the second ends 322*b* of the pins 322 via the conducting devices 37. Since the contact elements 361 of the circuit board 36 are electrically coupled with the second ends 322*b* of the pins 322 via the conducting devices 37, the plug 32 may be inserted into a power socket to transmit external power to the circuit board 36.

Figure 7:
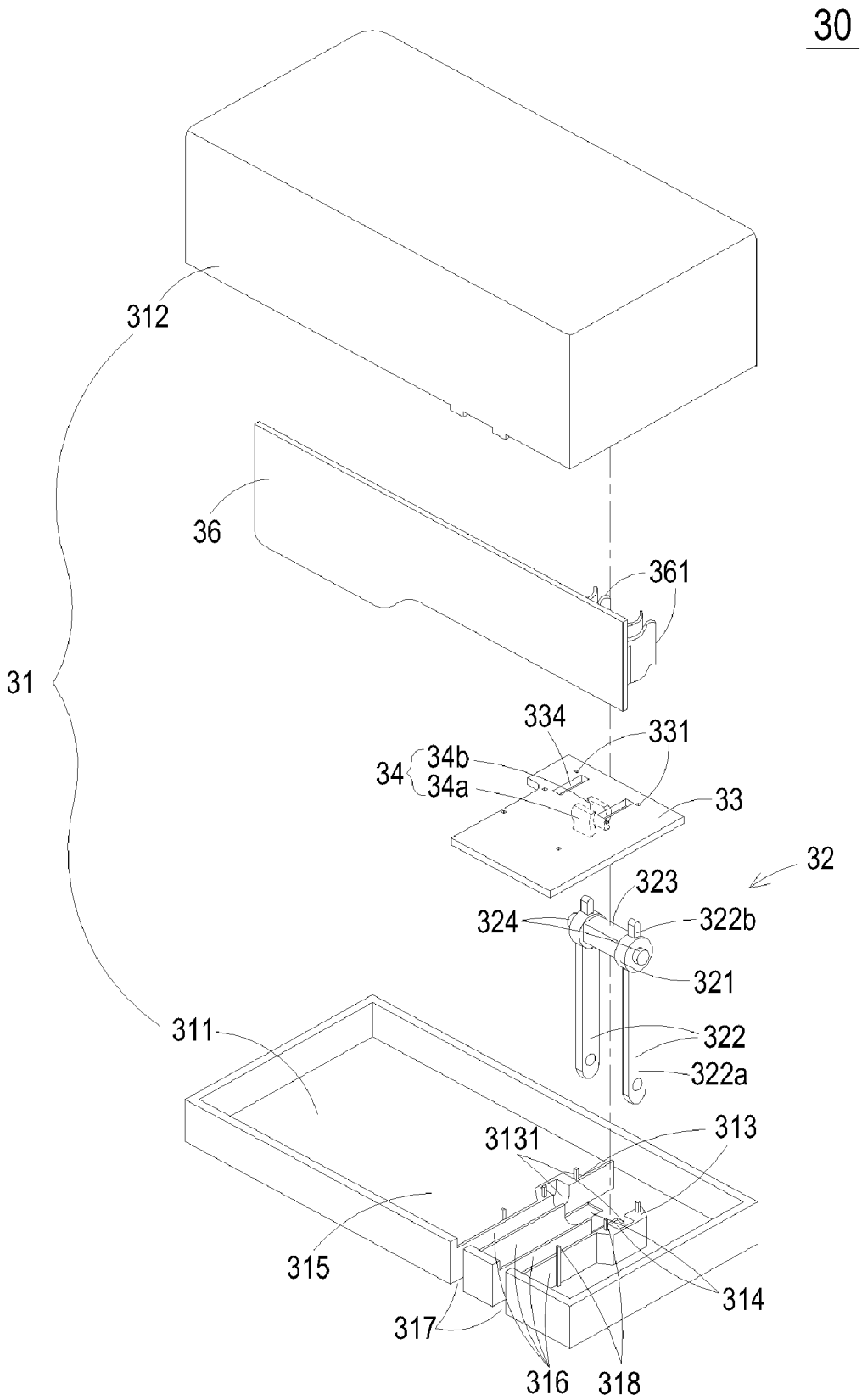
FIG. 7 is a schematic exploded view illustrating an electronic device having a foldable plug according to a third preferred embodiment of the present invention.

FIG. 7 is a schematic exploded view illustrating an electronic device having a foldable plug according to a third preferred embodiment of the present invention. In this embodiment, the casing 31, the plug 32, the fixing plate 33 and the circuit board 36 included therein are similar to those shown in FIG. 3, and are not redundantly described herein. In addition, the first retaining part 34 includes a first extension slice 34*a* and a second extension slice 34*b*, which are protruded from the lower surface 333 of the fixing plate 33. The engaging part 323 of the rotating shaft 321 is a rectangular bar, which is located at the middle of the rotating shaft 321. Moreover, the fixing plate 33 has several slots 334 allowing the second ends 322*b* of the pins 322 to penetrate therethrough.

Figure 8A:
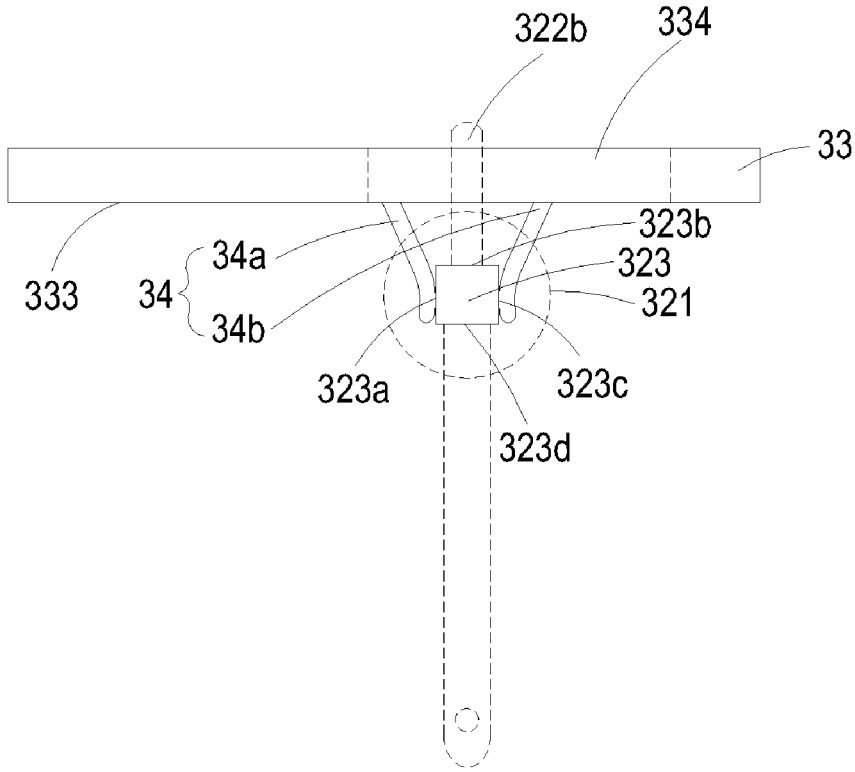
FIGS. 8A and 8B are respectively schematic cross-sectional views illustrating the relationship between the plug, the first retaining part and the rotating shaft of the electronic device of FIG. 7.
Figure 8B:
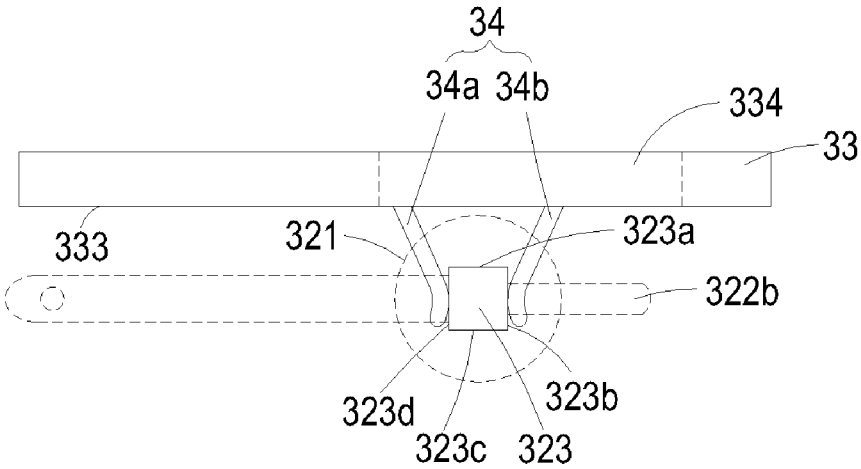

FIGS. 8A and 8B are respectively schematic cross-sectional views illustrating the relationship between the plug 32, the first retaining part 34 and the rotating shaft 321 of the electronic device of FIG. 7. Please refer to FIG. 7, FIG. 8A and FIG. 8B. As shown in the drawings, the distance between the first extension slice 34*a* and the second extension slice 34*b* are gradually shrunk from the lower surface 333 of the fixing plate 33. The engaging part 323 of the rotating shaft 321, for example a rectangular bar, includes a first side 323*a*, a second side 323*b*, a third side 323*c* and a fourth side 323*d*. The first side 323*a* is disposed adjacent to the second side 323*b* and is opposed to the third side 323*c*. The engaging part 323 of the rotating shaft 321 is arranged between these two extension slices 34*a* and 34*b*. As shown in FIG. 8A, when the plug 32 is rotated to the upright position, the first side 323*a* and the third side 323*c* of the rotating shaft 321 are sustained against the first extension slice 34*a* and the second extension slice 34*b*, respectively, such that the pins 322 of the plug 32 are positioned in the upright position. Moreover, since the contact elements 361 of the circuit board 36 are contacted with the second ends 322*b* of the pins 322, the plug 32 may be inserted into a power socket to transmit external power to the circuit board 36. As shown in FIG. 8B, when the plug 32 is rotated to the folded position, the second side 323*b* and the fourth side 323*d* of the rotating shaft 321 are sustained against the second extension slice 34*b* and the first extension slice 34*a*, respectively, such that the pins 322 of the plug 32 are positioned in the folded position. When the plug 32 is rotated to the folded position, the contact elements 361 of the circuit board 36 are separated from the second ends 322*b* of the pins 322.

From the above description, the plug is pivotally supported on the support member by fixing the rotating shaft between the fixing plate and the support member. When the first retaining part is engaged with or sustained against an engaging part of the rotating shaft, the pins of the plug will be positioned in the upright position or the folded position. Since the foldable plug of the present invention is easily assembled on the electronic device, the manufacturing cost and time are reduced. In addition, the foldable plug of the present invention is securely fixed in either the upright position or the folded position.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic device having a foldable plug, said electronic device comprising:

a casing having a support member and multiple perforations;

a plug having a rotating shaft and multiple pins, said pins being mounted on said rotating shaft, said rotating shaft is pivotally supported on said support member such that said pins being rotatable with respect to said rotating shaft to at least a first position and a second position, wherein said pins are penetrated through said perforation and substantially perpendicular to said casing when said pins are rotated to said first position, and said pins are received in said perforations when said pins are rotated to said second position;

a fixing plate disposed on said support member such that said plug is pivotally supported between said support member and said fixing plate;

a circuit board disposed within said casing and including multiple contact elements corresponding to said pins; and a first retaining part disposed on said fixing plate and engaged with an engaging part of said rotating shaft, thereby positioning said pins of said plug in said first position.

2. The electronic device according to claim 1 wherein each pin is partially embedded into said rotating shaft such that a first end and a second end of said pin are arranged on opposite sides of said rotating shaft, and said pins are substantially perpendicular to said rotating shaft.

3. The electronic device according to claim 2 wherein said circuit board and said plug are arranged on opposite sides of said fixing plate.

4. The electronic device according to claim 3 wherein said contact elements of said circuit board are contacted with said second ends of said pins when said plug is positioned at said first position, and said contact elements of said circuit board are separated from said second ends of said pins when said plug is positioned at said second position.

5. The electronic device according to claim 3 further comprising a plurality of conducting devices disposed on said fixing plate, wherein each of said conducting devices has a fixing part, a first contact part and a second contact part, said fixing part is secured on said fixing plate, said first contact part is contacted with one of said contact elements of said circuit board, and said second contact part is always contacted with one of said second ends of said pins when said plug is positioned at said first position and said second position.

6. The electronic device according to claim 1 wherein said support member is disposed on an inner surface of said casing, and said perforations are extended from said support member to an edge of said casing.

7. The electronic device according to claim 1 further including multiple partition plates, which are protruded from an inner surface of said casing, wherein said partition plates are connected to said support member and extended along the peripheries of the perforations.

8. The electronic device according to claim 7 wherein both terminals of said rotating shaft are formed as tenons, said support member has notches corresponding to said tenons, and said tenons of the rotating shaft are supported on said notches.

9. The electronic device according to claim 8 wherein said fixing plate is disposed on said support member to shelter said notches.

10. The electronic device according to claim 9 wherein said fixing plate is disposed on said support member and said partition plates such that multiple receiving parts are defined by said fixing plate, said partition plates and said perforations.

11. The electronic device according to claim 7 further includes at least one confining part, which is formed on said rotating shaft of said plug and between said pins, wherein said confining part is sustained against a peripheral of said partition plate for facilitating confining said plug in said first position.

12. The electronic device according to claim 11 further includes at least one stopping part, which is formed on said fixing plate, wherein said stopping part is sustained against said confining part for facilitating confining said plug in said first position.

13. The electronic device according to claim 1 wherein said first retaining part is a hook structure and said engaging part of said rotating shaft is a protrusion structure, and said first retaining part is integrally formed on said fixing plate.

14. The electronic device according to claim 1 further including a second retaining part disposed on an inner surface of said casing for engaging with or sustaining against said engaging part of said rotating shaft, thereby positioning said pins of said plug in said second position.

15. The electronic device according to claim 14 wherein said second retaining part is a hook structure and said engaging part of said rotating shaft is a protrusion structure, and said second retaining part is integrally formed on said casing.

16. The electronic device according to claim 1 further including one or more friction-enhancing elements, which are arranged on an inner surface of said casing and in the vicinity of said perforations, for enhancing friction on said rotating shaft.

* * * * *